US009226589B2

(12) United States Patent
Tully

(10) Patent No.: US 9,226,589 B2
(45) Date of Patent: Jan. 5, 2016

(54) COLLAPSIBLE BED SYSTEM

(71) Applicant: Berg Companies, Inc., Spokane, WA (US)

(72) Inventor: Travis Tully, Spokane, WA (US)

(73) Assignee: Berg Companies, Inc., Spokane, WA (US)

( * ) Notice: Subject to any disclaimer, the term of this patent is extended or adjusted under 35 U.S.C. 154(b) by 215 days.

(21) Appl. No.: 13/843,671

(22) Filed: Mar. 15, 2013

(65) Prior Publication Data

US 2014/0259387 A1 Sep. 18, 2014

(51) Int. Cl.

| | |
|---|---|
| ***A47B 83/00*** | (2006.01) |
| ***A47D 11/00*** | (2006.01) |
| ***A47C 19/00*** | (2006.01) |
| ***A47C 19/20*** | (2006.01) |
| *A47C 19/02* | (2006.01) |

(52) U.S. Cl.

CPC ..... *A47C 19/005* (2013.01); *A47C 19/20* (2013.01); *A47C 19/202* (2013.01); *A47C 19/028* (2013.01)

(58) Field of Classification Search

CPC .... A47C 19/005; A47C 19/20; A47C 19/202; A47C 19/028

See application file for complete search history.

(56) References Cited

U.S. PATENT DOCUMENTS

| | | | | | |
|---|---|---|---|---|---|
| 97,981 | A * | 12/1869 | Snead | | |
| 4,103,373 | A * | 8/1978 | Luedtke et al. | 5/166.1 | |
| 4,109,328 | A * | 8/1978 | Mason | 5/2.1 | |
| 4,232,411 | A * | 11/1980 | Speyer | 5/8 | |
| 4,450,597 | A * | 5/1984 | Hull | 5/2.1 | |
| 4,592,101 | A * | 6/1986 | Page | 5/9.1 | |
| 5,211,130 | A * | 5/1993 | Elias et al. | 119/28.5 | |
| 5,713,650 | A * | 2/1998 | King et al. | 312/265.4 | |
| 5,983,420 | A * | 11/1999 | Tilley | 5/2.1 | |
| 6,353,945 | B1 * | 3/2002 | Jannetides | 5/9.1 | |
| 6,721,969 | B1 * | 4/2004 | Lupo et al. | 5/9.1 | |
| 6,983,494 | B1 * | 1/2006 | Jannetides | 5/9.1 | |
| 7,051,384 | B1 * | 5/2006 | Guillot et al. | 5/9.1 | |
| 7,360,261 | B1 * | 4/2008 | Sheliga | 5/12.1 | |
| 7,793,367 | B1 * | 9/2010 | Ruiter et al. | 5/282.1 | |
| 7,832,031 | B1 * | 11/2010 | Lupo | 5/9.1 | |
| 7,845,030 | B1 * | 12/2010 | Pollard | 5/308 | |
| 2002/0189012 | A1 * | 12/2002 | Connell | 5/9.1 | |
| 2005/0050633 | A1 * | 3/2005 | Rogers | 5/9.1 | |
| 2006/0085909 | A1 * | 4/2006 | McBrayer et al. | 5/2.1 | |
| 2006/0162066 | A1 * | 7/2006 | Glattstein et al. | 5/2.1 | |
| 2006/0260044 | A1 * | 11/2006 | Nebel | 5/118 | |
| 2008/0078026 | A1 * | 4/2008 | Thomas | 5/400 | |
| 2008/0244827 | A1 * | 10/2008 | Caon et al. | 5/200.1 | |
| 2010/0043139 | A1 * | 2/2010 | Bonatz | 5/9.1 | |
| 2010/0180379 | A1 * | 7/2010 | Leng | 5/425 | |
| 2010/0269254 | A1 * | 10/2010 | Sanders, Jr. | 5/2.1 | |
| 2010/0319120 | A1 * | 12/2010 | Woodhams | 5/2.1 | |
| 2013/0000037 | A1 * | 1/2013 | Tabbia | 5/93.1 | |
| 2013/0097782 | A1 * | 4/2013 | Carrier | 5/607 | |
| 2014/0259378 | A1 * | 9/2014 | Combs et al. | 4/643 | |

* cited by examiner

*Primary Examiner* — David E Sosnowski
(74) *Attorney, Agent, or Firm* — Lee & Hayes, PLLC

(57) ABSTRACT

A collapsible bed system is disclosed that may comprise a first bunk, a second bunk, a first frame member, and second frame member. The collapsible bed system may be moved between a stowed state and a deployed state. The first bunk may comprise a container and a platform, the platform being hingedly connected to the container over a top opening of the container, enclosing a volume within the container. In the deployed state, a mattress may be positioned on top of the platform and in a stowed state, the mattress may be positioned in the enclosed volume. The collapsible bed system may include a foldable drawer configured to be received by a foldable drawer opening arranged on the first bunk.

20 Claims, 8 Drawing Sheets

COLLAPSIBLE BED SYSTEM

BACKGROUND

Various portable bedding structures have been developed for deployment at a remote site. Field hospitals, barracks, fire response units, disaster relief shelters, holding cells, exploration camps, and schools are some applications that may require portable bedding structures. To deploy a bedding structure, the bedding structure may be transported to a remote site and set-up at the site. When the portable bedding structure is no longer needed, it may be taken down for transportation to another location. These set-up and take-down processes often require a relatively large amount of time and many personnel. Existing bedding structures tend to either be very light weight and portable (e.g., camp cots) or very heavy and bulky (e.g., permanent or semi-permanent bed systems). In some instances, existing portable bedding structures includes storage space for personal items. However, the storage elements tend to be burdensome to disassemble and/or require additional space to stow for transportation. As more institutions require portable equipment suitable for remote site applications, particularly in the military environment, there is an increasing need for equipment that is easily collapsible and transportable.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1:
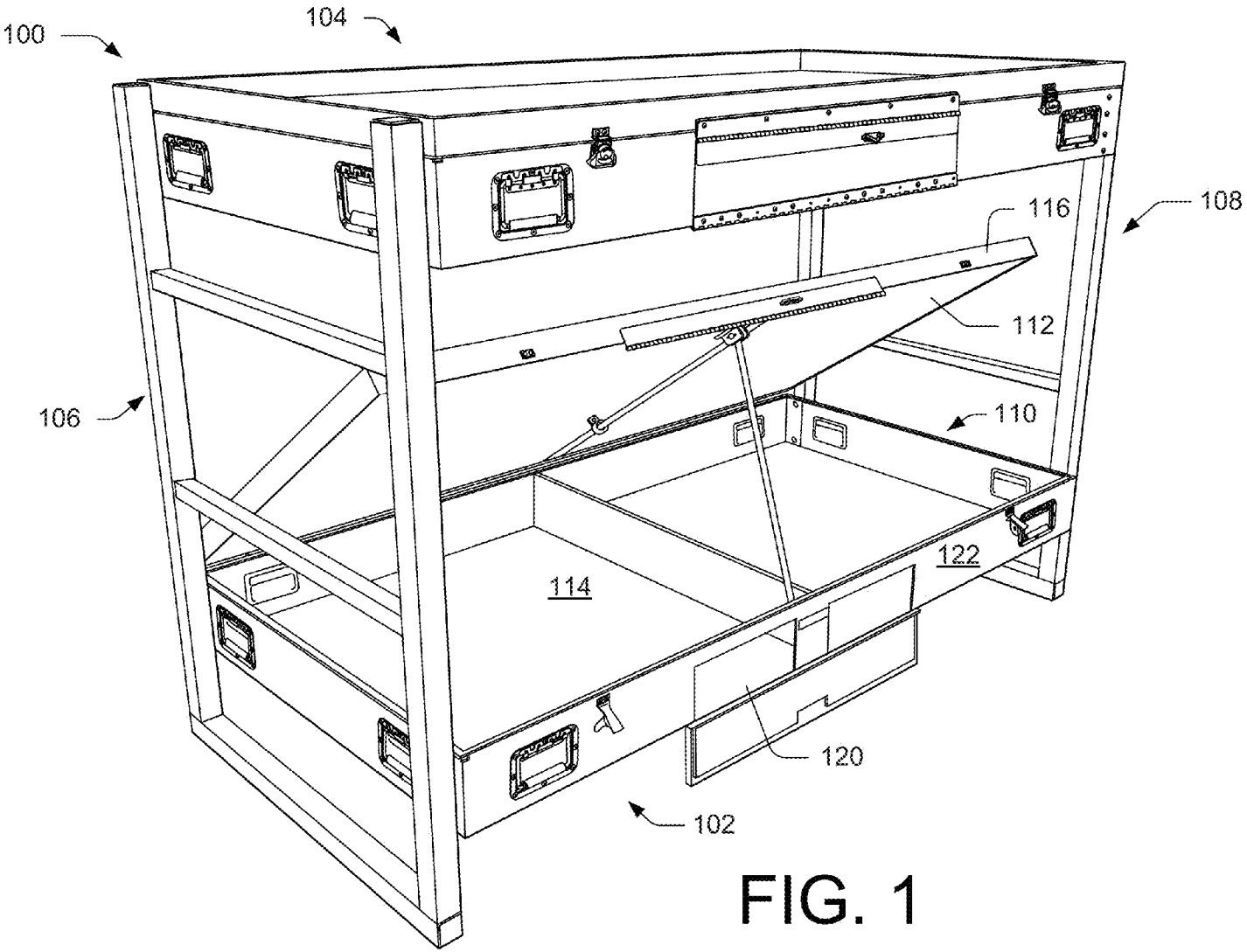
FIG. 1 is a perspective view of an example collapsible bed system in a deployed state.

As discussed above, portable bedding structures are often deployed at remote sites, requiring the portable bedding structures to be transported to and set-up at the sites. Due to the need to change locations frequently and quickly, as in many applications, including the military, the portable bedding structures may be taken down and transported quite often. However, as noted above, conventional bedding structures take considerable time and personnel to set-up and take down, making them ill-suited for rapid deployment. Conventional bedding structures also tend to be bulky and/or not self-contained. Further, in conventional bedding structures that include storage elements, such as shelves or compartments, the bedding structures may be burdensome to disassemble and/or may require additional space to stow for transportation.

This disclosure describes a bedding structure that is collapsible to form a compact portable structure. The bedding structure may be easily movable between a deployed state and a stowed state in which the bedding structure is compact and self-contained to enable transportation of the bedding structure. One example embodiment employs a portable bedding structure that includes a first bunk and a second bunk. The first and second bunks may each include a substantially rectangular container with a platform over the top. The platform, in some examples, may have a lip extending upward from the top edges of the platform. When the bedding structure is in a deployed state, this lip may retain a mattress.

In some embodiments, the bunks may include a drawer opening located on a side of each of the bunks. The drawer opening may be configured to receive one or more drawers, when the portable bedding structure is in the deployed state. In some examples the drawer(s) may have a planar base and four upstanding, foldable walls that are upright in the deployed state.

The portable bedding structure may also include a first frame member and a second frame member for supporting the bunks in a horizontal position spaced vertically apart from each other in the deployed state. The frame members may comprise first and second vertical rails that are held substantially parallel to each other by a plurality of crossbars that may couple to the rails.

It may be desirable in some applications for the portable bedding structure to be easily movable between the deployed state and a stowed state. In a stowed state, the mattress may be moved from its position atop the platform of the bunk to the volume within the container of the bunk. The platform may be hingedly coupled to the container so that it can be pivoted to an open position and access can be gained to the interior volume of the container. Once the mattress is placed in the container, the platform may be closed and latched to securely store the mattress and potentially other items in the stowed state for transport.

In the stowed state, the drawer(s) (if included) may have foldable walls moved from an upright position, perpendicular to the planar base, to a folded position with the walls substantially coplanar with the base. When the drawer(s) are in the folded position, they may be substantially flat, occupying a relatively small volume. The folded drawer(s) may be stowed adjacent to the mattress in the enclosed container volume when the portable bedding structure is in the stowed state.

The first and second frame members may be decoupled from the bunks when, as in some embodiments, the portable bunk bed is converted to a stowed position. In some embodiments, the method of coupling/decoupling of the frame members to the bunks may be simple and tool-free, such as with a latch, to allow for quick deployment/stowage.

In some embodiments, the first frame member may be removably coupled to the platform of the first bunk when the portable bedding structure is in the stowed state. Similarly, the second frame member may be removably coupled to the platform of the second bunk in this state. With the first and second frame members adjoined to the first and second bunks, respectively, the first and second bunks may be coupled together, the lip of the first bunk abutting the lip of the second bunk. The coupling may be maintained with a tool-free latch, in some examples. In the stowed state, the portable bedding structure may resemble a rectangular cuboid and, in some embodiments, may have a thickness of at most about 18 inches, a width of at most about 36 inches, and a length of at most about 78 inches. In some embodiments, portable bedding structures according to this disclosure (including two bunks, frame members, mattresses, and drawers) weigh at most about 250 pounds. However, in other embodiments, collapsible bed systems according to this disclosure may have dimensions and/or weights larger or smaller than those given above. In the stowed state, the portable bedding structure may contain all of the separable components (the bunks, the frame members, the mattresses, and the drawers) into a single rectangular cuboid unit, which, in some examples, is self-contained and easily transportable. Some embodiments within the scope of this disclosure may include additional, or alternative, elements. Examples of several embodiments are disclosed with reference to the figures.

Multiple and varied example implementations and embodiments are described below. However, these examples are merely illustrative, and other implementations and embodiments may be used to deploy a portable bedding structure that includes one or more bunks and is movable between a deployed state and a stowed state without departing from the scope of the claims.

Example Collapsible Bed System

Turning now to the figures, details are provided concerning various example embodiments. In general, the embodiments disclosed in the figures are presented by way of example. Thus, the figures should not be considered as constraining the scope of the claims in any way. The components disclosed in the figures may be combined as desired to create a portable bunk bed. The components disclosed in the figures may be rearranged, modified, duplicated, and/or omitted in some configurations.

With reference to FIG. 1, an example embodiment of a portable bedding system or collapsible bed system 100 is disclosed that includes a first bunk 102, a second bunk 104, a first frame member 106, and a second frame member 108. In the illustrated example, the first bunk 102 and the second bunk 104 are substantially similar in size and configuration so that any description set forth pertaining to the first bunk 102 may also apply to the second bunk 104. Similarly, the first frame member 106 and the second frame member 108 may be substantially similar in size and configuration so that any description set forth pertaining to the first frame member 106 may also apply to the second frame member 108. However, in other embodiments the first and second bunks may be different in size shape and/or configuration. Similarly, in other embodiments the first and second frame members may be different in size shape and/or configuration.

The first bunk 102 may, in some examples, comprise a container 110 and a platform 112 hingedly coupled to an edge of the container so that the platform 112 may, in a first (closed) position, cover an opening of the container 110. The container may, in some embodiments, be substantially rectangular in form. In a second (open) position, the platform 112 may be positioned at an angle relative to the container 110, exposing a volume 114 of the container 110. Both the first position and the second position are illustrated by the first bunk 102 and the second bunk 104, respectively, in FIG. 1.

Figure 2:
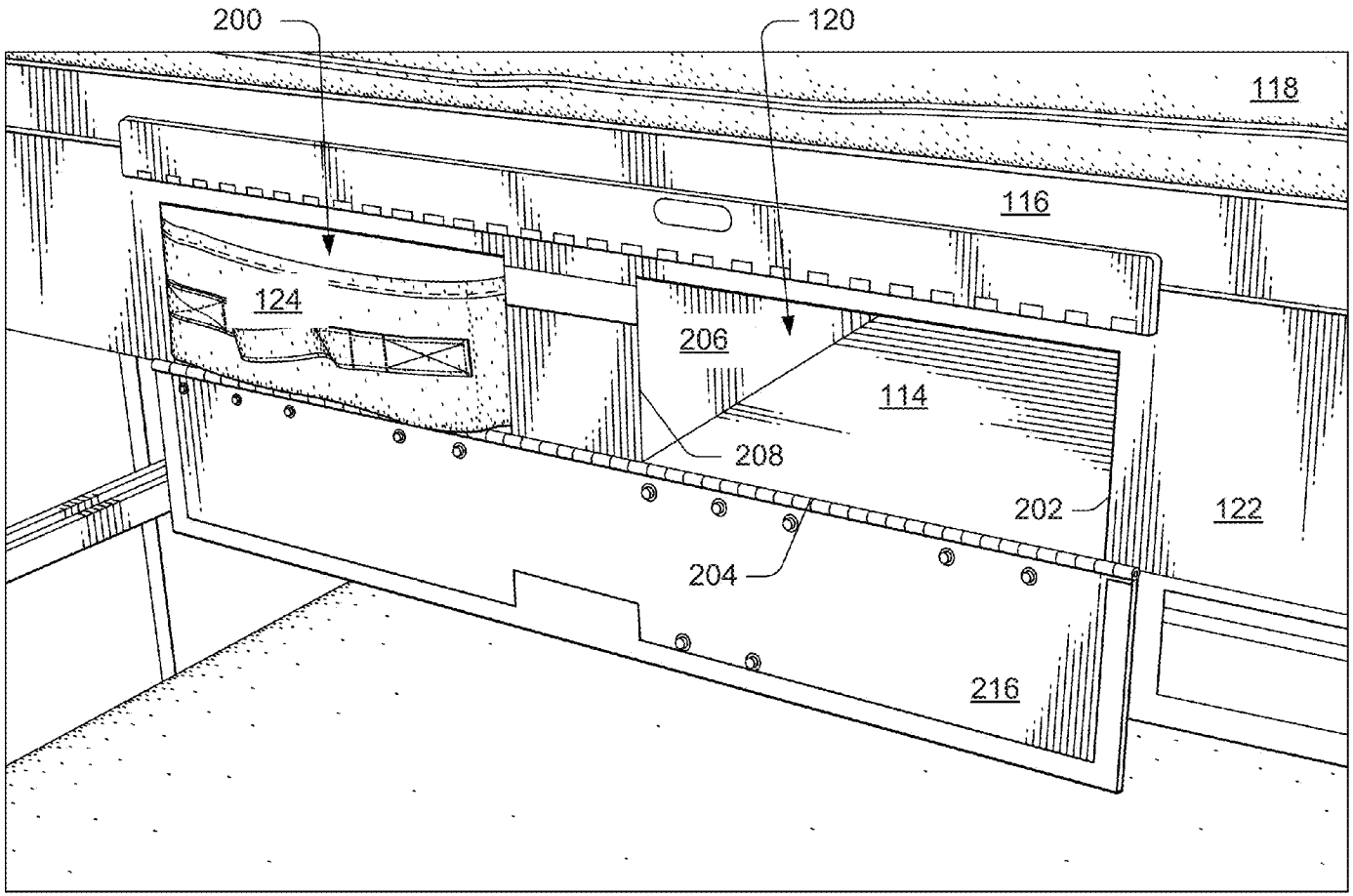
FIG. 2 is a partial perspective view of an example drawer opening disposed on a side of a bunk with a foldable drawer in a retracted position.
Figure 3:
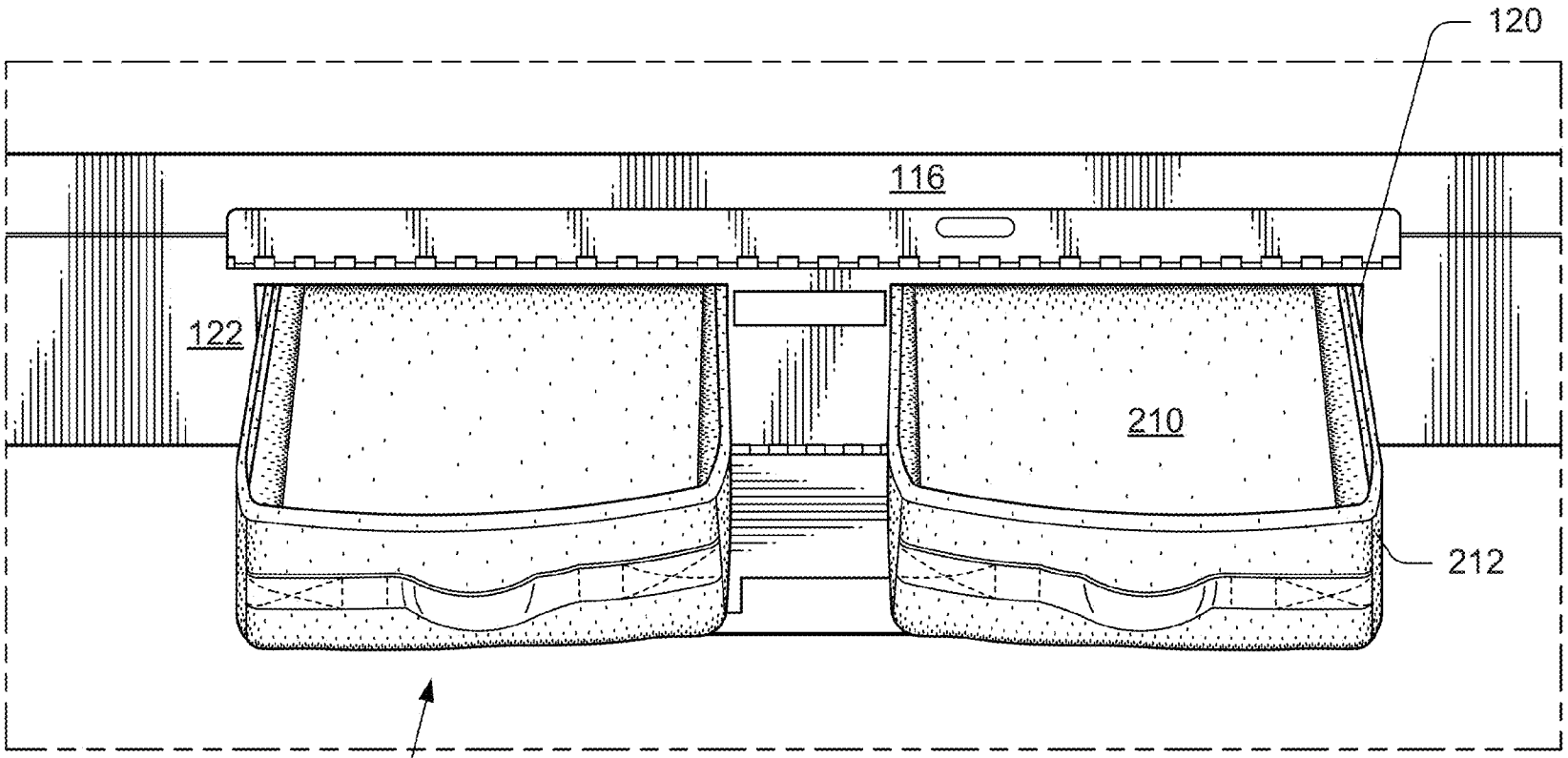
FIG. 3 is a partial perspective view of the example foldable drawer of FIG. 2 in an extended position.
Figure 4:
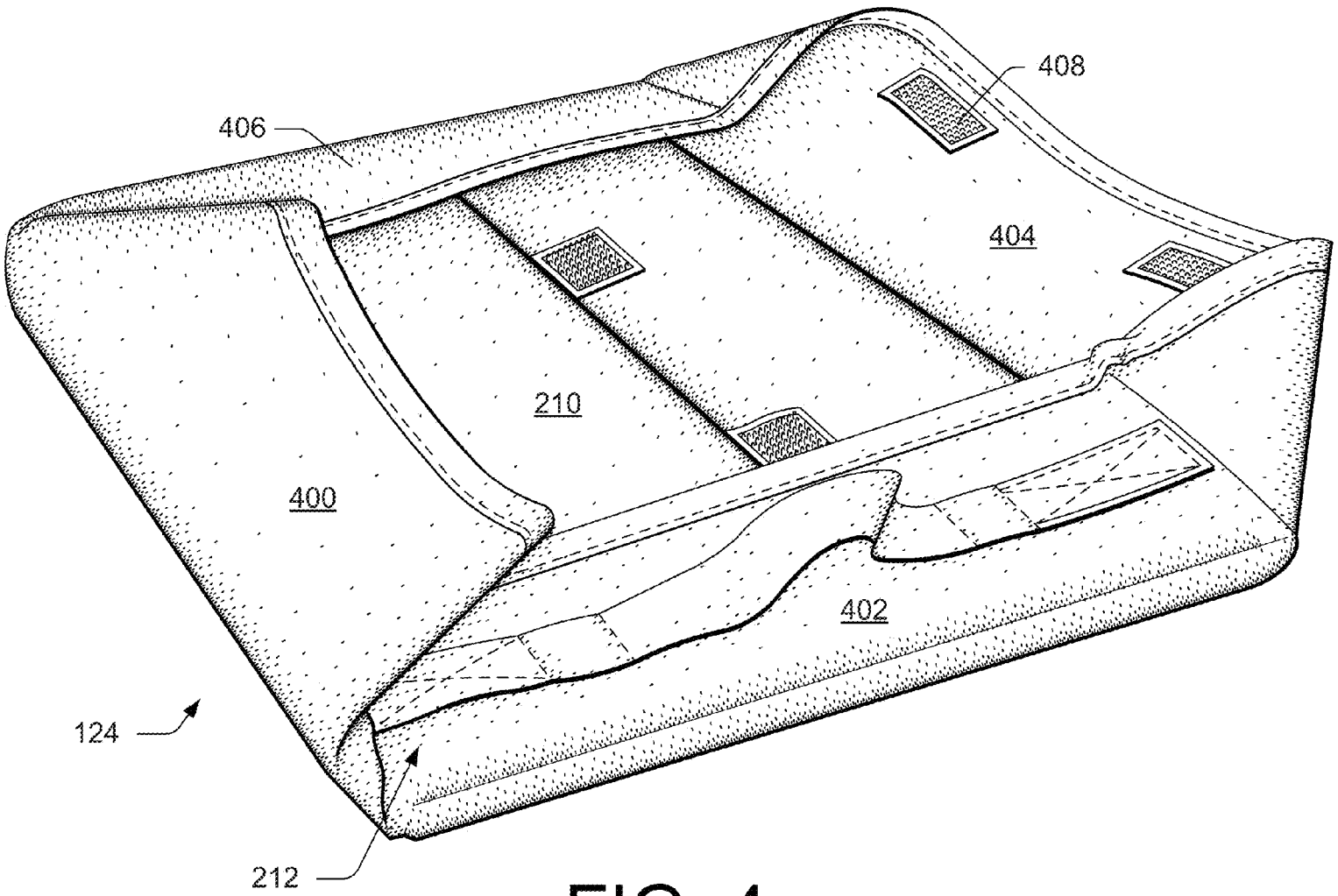
FIG. 4 is a perspective view of the example foldable drawer of FIG. 3 in a partially folded position.

The first bunk 102 may comprise a lip 116 that extends upwards from the platform 112 away from the container 110. In some embodiments a mattress 118 (FIG. 2) may be retained by the lip 116, when the collapsible bed system 100 is in a deployed state. The first bunk 102 may, in some examples, comprise a drawer opening 120, disposed on a side 122 of the container 110. The drawer opening 120 may be configured (e.g. have substantially similar dimensions) to receive one or more foldable drawers 124 (FIG. 2-4). Although FIG. 1 illustrates an example with the drawer opening 120 positioned on the side 122 of the container, the drawer opening 120 may, in other examples, be positioned on any side of the container 110. Further, any number of drawer openings 120 may be implemented. The first bunk 102, and the components of the bunk 102, such as the container 110, the platform 112, and the lip 116, may be constructed of metal, wood, plastic, glass composites, ceramic composites or any other material that is substantially planar and rigid or semi-rigid. The components may be constructed of the same material, of different material, or any combination of materials.

The collapsible bed system 100 may, in some embodiments, have the first drawer opening 120 and a second drawer opening 200, as shown in FIG. 2 and FIG. 3. In some examples the first drawer opening 120 may be defined by a first edge 202, a second edge 204, a third edge 206 and a fourth edge 208, the edges 202, 204, 206 and 208 having dimensions configured to receive the foldable drawer 124. The foldable drawer 124 may comprise a planar base 210 and a plurality of sides 212, the plurality of sides 212 being upright when the collapsible bed system 100 is in a deployed state. The foldable drawer 124 may be in a retracted position, as shown in FIG. 2, wherein the drawer partially occupies the volume 114 of the container 110. The foldable drawer 124 may be in an extended position, as shown in FIG. 3, wherein the drawer is outside the volume 114 of the container 110. In some embodiments, the first bunk 102 may include a panel 216 hingedly coupled to the side 122 containing the drawer opening 120, so that the panel 216 may be movable between covering the drawer opening 120 and exposing the drawer opening 120. The panel 216 may comprise a same material as the bunk or a different material.

FIG. 4 illustrates, by way of example, the foldable drawer 124 being moved between an upright position and a folded position. The foldable drawer 124 may include the planar base 210 and the plurality of sides 212, the plurality of sides 212 including a first side 400, a second side 402, a third side 404, and a fourth side 406. When in the upright position, such as in the examples illustrated in FIGS. 2 and 3, the plurality of sides 212 may be substantially perpendicular to the planar base 210. In the folded position, the plurality of sides 212 may be folded down so that they are adjacent to and substantially parallel to the planar base 210. A method of maintaining the sides 212 in the folded position, such as a hook and loop fastener 408, may be implemented in some examples. In some embodiments, the collapsible bed system 100 may be in a stowed state, in which case the foldable drawer 124 may be in the folded position and stored in the volume 114. The foldable drawer 124 may comprise a rigid material, such as sheet metal, that utilizes a hinge for folding, or the foldable drawer 124 may comprise a flexible or semi-rigid material, such as plastic, cardboard, canvas, a combination thereof, or the like, and may utilize a living hinge for folding, as illustrated in the example of FIG. 4.

Figure 5:
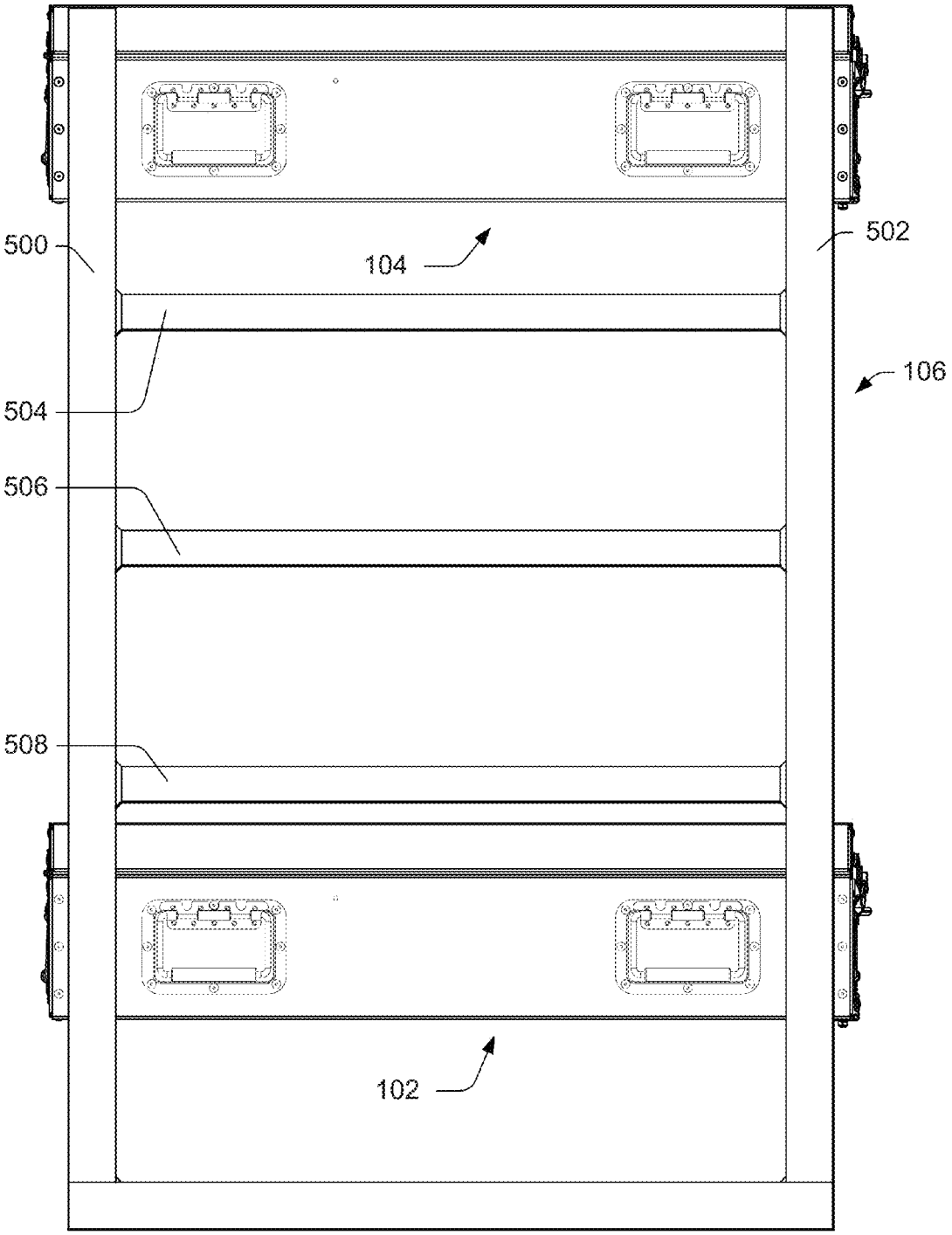
FIG. 5 is a front elevation view of an example collapsible bed system.
Figure 6:
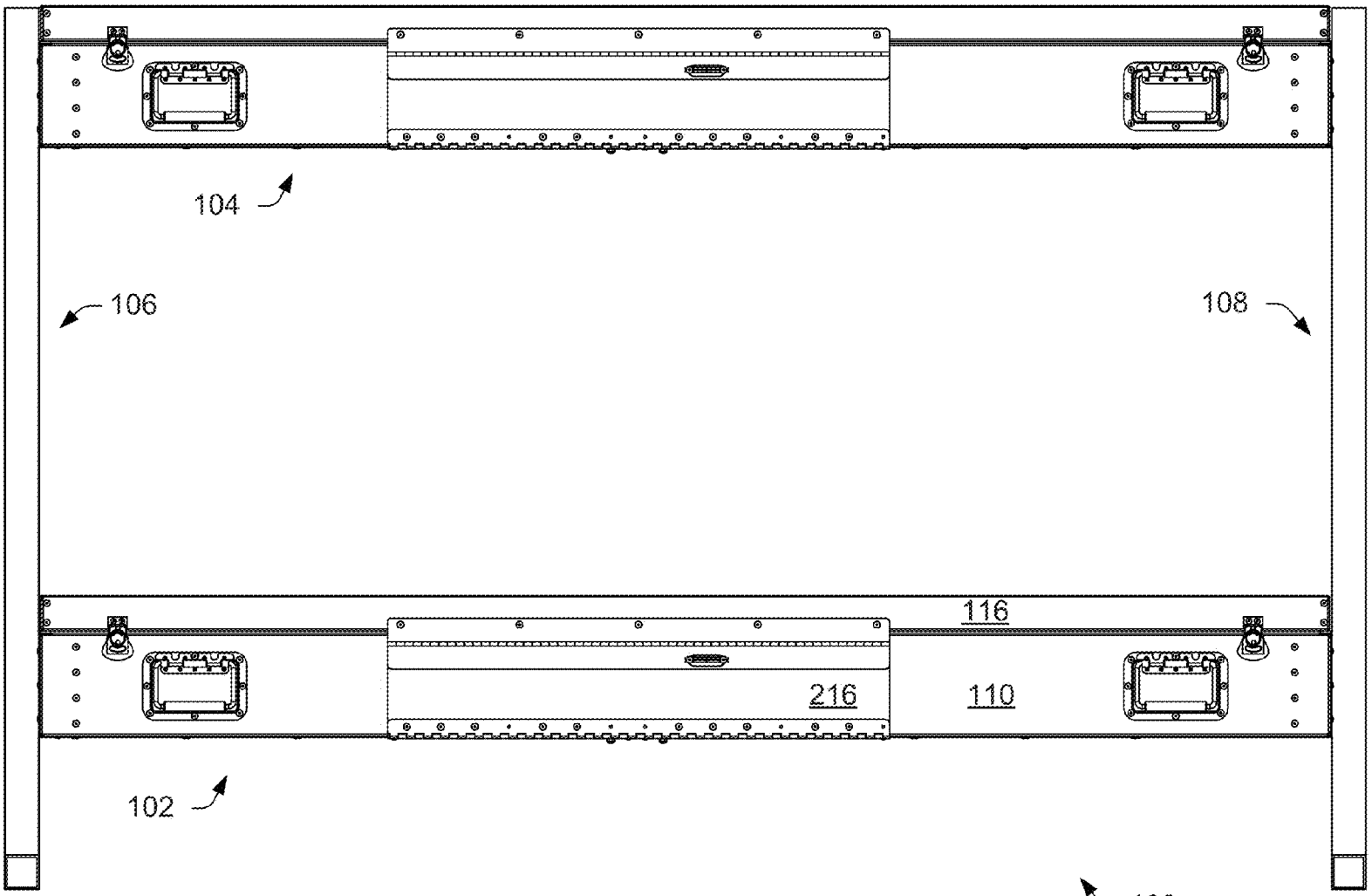
FIG. 6 is a side elevation view of the example collapsible bed system of FIG. 5.

The collapsible bed system 100 may comprise the first frame member 106 and the second frame member 108, coupled to the bunks 102 and 104 when the collapsible bed system 100 is in the deployed state, as illustrated by way of example in FIGS. 5 and 6. The first frame member 106 may comprise a first rail 500 and a second rail 502 substantially parallel to the first rail 500. A cross bar 504 may couple to the first rail 500 and the second rail 502, maintaining the first rail 500 and the second rail 502 in the parallel configuration relative to each other. In some embodiments, there may be a second cross bar 506 and a third cross bar 508. Any number of cross bars 504, 506, and 508 may be implemented in order to provide lateral support for the rails 500 and 502. When the collapsible bed system 100 is in the deployed state, the plurality of cross bars, 504, 506, and 508 may function as a ladder, providing access to the first bunk 102 when the first bunk 102 is in an elevated position. The components of the first frame member 106, such as the first rail 500, the second rail 502, and the plurality of cross bars 504, 506, and 508, may be comprised of metal, wood, plastic, glass composites, ceramic composites, or any other material that is substantially rigid. In one embodiment, the first frame member 106 may be comprised of tubular sheet metal with a substantially rectangular cross-section profile.

Figure 7:
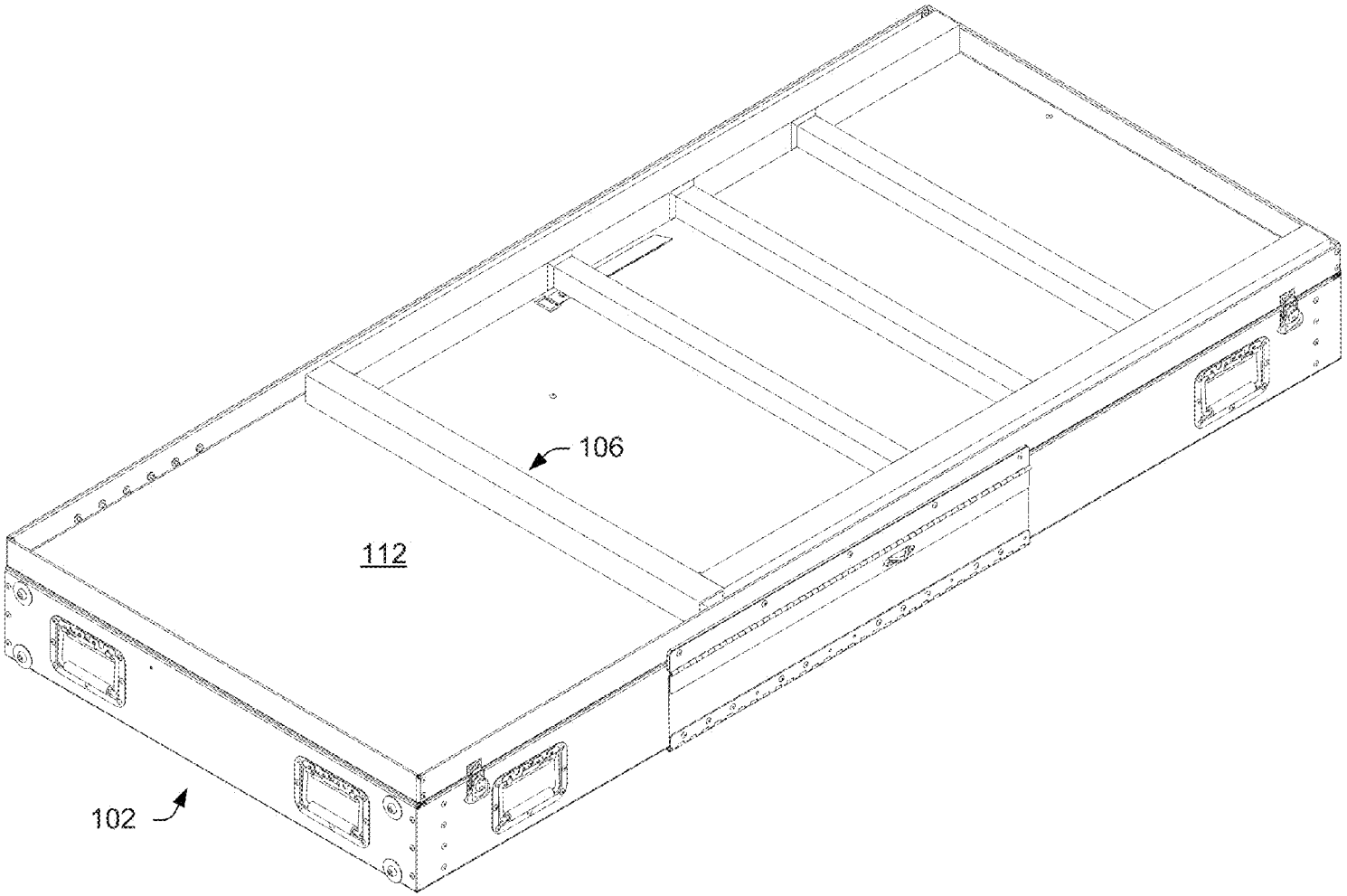
FIG. 7 is an isometric view of an example frame member affixed to an example bunk in a stowed state.
Figure 8:
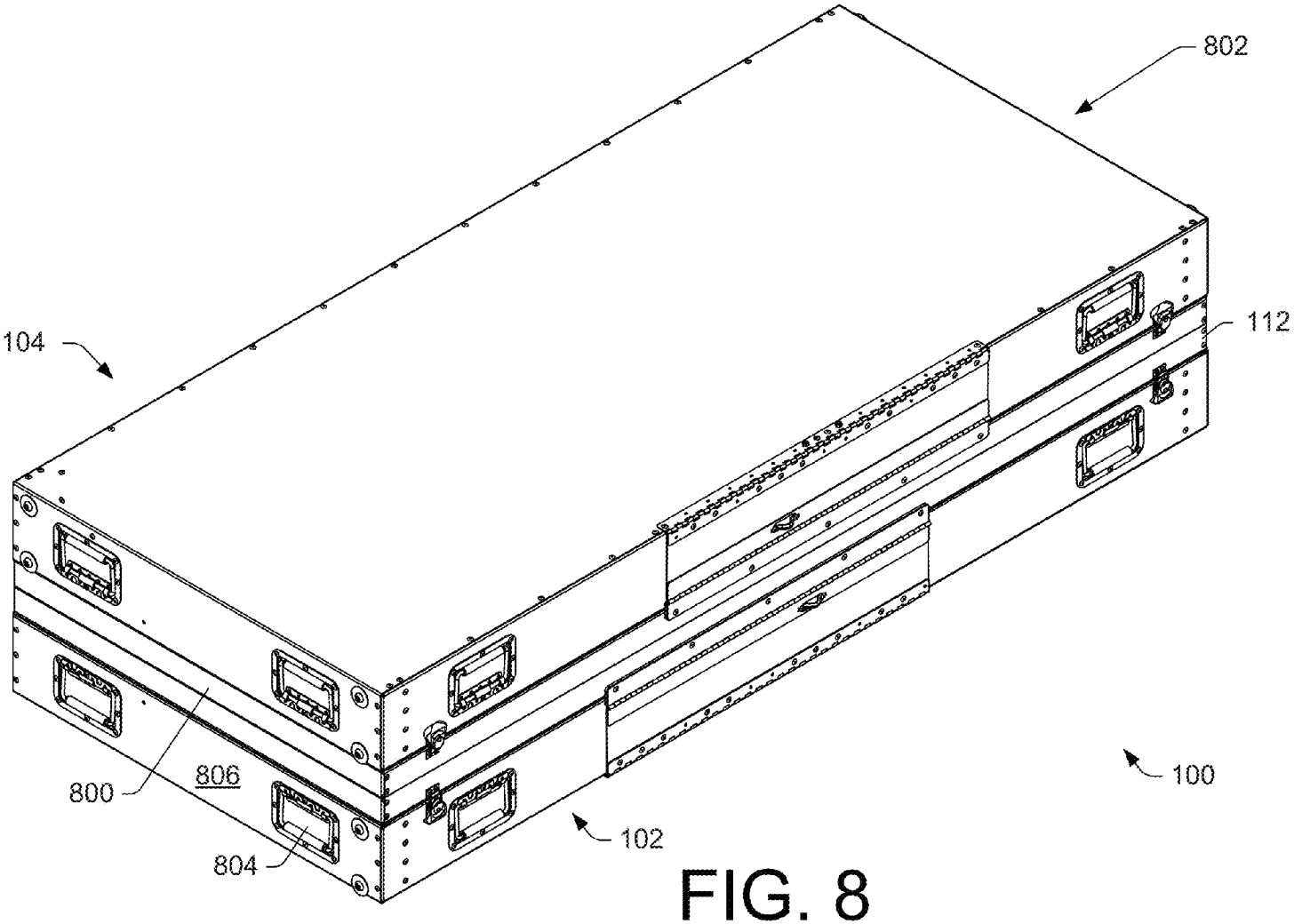
FIG. 8 is an isometric view of an example first bunk coupled to a second bunk in a stowed state.

In some embodiments, the collapsible bed system 100 may be changeable between a deployed state and a stowed state, the stowed state being illustrated by way of example in FIGS. 7 and 8. In the stowed state, the first frame member 106 may be affixed to the platform 112 of the first bunk 102. Straps, hooks, latches, or any other method of coupling may be used to retain the first frame member 106 onto the platform 112. When stowed, the first bunk 102 of the illustrated embodiment may have a thickness of at most about 9 inches. The second frame member 108 may be affixed to a second platform 800 of the second bunk 104, in a similar manner to first frame member 106. The first bunk 102 with the first frame member 106 attached may be coupled to the second bunk 104 with the second frame member 108 attached when the collapsible bed system 100 is in the stowed state. The first platform 112 may abut the second platform 800 in this state, so that the collapsible bed system 100 may comprise a substantially rectangular cuboid 802.

In some examples, a handle 804 may be situated on the collapsible bed system 100, as shown in FIG. 8. The handle may be comprised of metal or another rigid material and may be positioned substantially indented into a surface 806 of the collapsible bed system 100. The handle 804 may be spring loaded inward so that it is flush with or recessed relative to the surface 806 when not in use. Any number of handles may be employed, and on any surface of the collapsible bed system 100.

In some embodiments, the collapsible bed system 100 may form a rectangular cuboid 802 when in the stowed state. The rectangular cuboid 802 may have a thickness of about 17 inches, a width of about 35 inches, a length of about 77 inches, and/or a weight of about 230 pounds, in some examples. A latch 808 may be implemented to couple the first platform 112 to the first container 110, maintaining the rectangular cuboid 802 profile. Thus, in the stowed state the collapsible bed system 100 is compact, self-contained, light weight, and therefore easily transportable.

Conclusion

Although the application describes embodiments having specific structural features and/or methodological acts, it is to be understood that the claims are not necessarily limited to the specific features or acts described. Rather, the specific features and acts are merely illustrative of some embodiments that fall within the scope of the claims of the application.

What is claimed is:

1. A collapsible bunk bed system comprising:

a first bunk comprising:

a first container sized to receive a first mattress when the collapsible bunk bed system is in a stowed state;

a first platform covering an opening of the first container, the first platform configured to support the first mattress when the collapsible bunk bed system is in a deployed state; and a first retaining lip coupled to the first platform and extending along a length of the first container substantially from a first terminal end of the first container to an opposing second terminal end of the first container;

a second bunk comprising:

a second container sized to receive a second mattress when the collapsible bunk bed system is in the stowed state;

a second platform covering an opening of the second container, the second platform configured to support the second mattress when the collapsible bunk bed system is in the deployed state;

a second retaining lip coupled to the second platform and extending along a length of the second container substantially from a first terminal end of the second container to an opposing second terminal end of the second container; and first and second frame members to support the first bunk relative to the second bunk when the collapsible bunk bed system is in the deployed state;

wherein when the collapsible bunk bed system is in a deployed state, the first retaining lip is located at a to of the first container, and the second retaining lip is located at a top of the second container; and wherein when the collapsible bunk bed system is in the stowed state, an orientation of the first container is same as in the deployed state, and an orientation of the second container is inverted so that the first retaining lip and the second retaining lip abut and are flush substantially along the lengths of the first and second containers, such that the collapsible bunk bed system forms a substantially rectangular cuboid.

2. The collapsible bunk bed system of claim 1, wherein in the stowed state, the first mattress and the first frame member are within a volume of the first bunk and the second mattress and the second frame member are within a volume of the second bunk.

3. The collapsible bunk bed system of claim 2, wherein in the stowed state, the collapsible bunk bed system has a thickness of at most about 18 inches.

4. The collapsible bunk bed system of claim 3, wherein in the stowed state, the collapsible bunk bed system has a width of at most about 36 inches and a length of at most about 78 inches.

5. The collapsible bunk bed system of claim 1, further comprising:

a drawer opening disposed in a side of each of the first and second containers; and a foldable drawer configured to be received by the drawer opening in the side of each of the first and second containers when in the deployed state.

6. The collapsible bunk bed system of claim 5, wherein in the stowed state, the foldable drawers fit within a volume of the first and second bunks.

7. The collapsible bunk bed system of claim 1, wherein the first and second platforms are hingedly coupled to the first and second containers, respectively.

8. A collapsible bunk bed system comprising:

a stowed state and a deployed state;

a first bunk comprising:

a first container sized to receive a first mattress when the collapsible bunk bed system is in the stowed state;

a first platform covering an opening of the first container; and a first retaining lip coupled to the first platform and extending along a length of the first container substantially from a first terminal end of the first container to an opposing second terminal end of the first container; and a second bunk comprising:

a second container sized to receive a second mattress when the collapsible bunk bed system is in the stowed state;

a second platform covering an opening of the second container; and a second retaining lip coupled to the second platform and extending along a length of the second container substantially from a first terminal end of the second container to an opposing second terminal end of the second container;

wherein when the collapsible bunk bed system is in the deployed state, the first retaining lip is spaced apart from the second retaining lip; and wherein when the collapsible bunk bed system is in the stowed state, the first retaining lip and the second retaining lip abut and are flush substantially along the lengths of the first and second containers, such that the collapsible bunk bed system forms a substantially rectangular cuboid.

9. The collapsible bed system of claim 8, further comprising a first frame member within the volume of the first bunk and a second frame member within the volume of the second bunk when the collapsible bunk bed system is in the stowed state.

10. The collapsible bed system of claim 9, wherein, in the stowed state, the first mattress is within a volume of the first bunk, and the second mattress is within a volume of the second bunk.

11. The collapsible bed system of claim 10, wherein, in the stowed state, the first or second bunk has a thickness of at most about 9 inches.

12. The collapsible bed system of claim 11, wherein, in the stowed state, the first or second bunk has a width of at most about 36 inches and a length of at most about 78 inches.

13. The collapsible bed system of claim 8, wherein the platforms are hingedly coupled to their respective containers.

14. The collapsible bed system of claim 8, further comprising one or more latches to connect the platforms to their respective containers.

15. A collapsible bunk bed system comprising:

a first bunk comprising:

a first container sized to receive a first mattress when the collapsible bunk bed system is in a stowed state;

a first platform covering an opening of the first container, the first platform configured to support the first mattress when the collapsible bunk bed system is in a deployed state; and a first handle recessed into a surface of the first container, the handle being spring-loaded inwardly towards the surface of the first container, said first handle further having an upper end about which it is pivotable; and a second bunk comprising:

a second container sized to receive a second mattress when the collapsible bunk bed system is in the stowed state;

a second platform covering an opening of the second container, the second platform configured to support the second mattress when the collapsible bunk bed system is in the deployed state; and a second handle recessed into a surface of the second container, the handle being spring-loaded inwardly towards the surface of the second container, said second handle further having an upper end about which it is pivotable;

when the collapsible bunk bed system is in the deployed state, the second handle is positioned to pivot about its upper end so as to move in a direction away from the first container and away from the first handle;

wherein when the collapsible bunk bed system is in the stowed state, an orientation of the first container is the same as during the deployed state, and an orientation of the second container is inverted such that when operated, pivoting of the second handle moves said second handle in a direction toward the first container and toward said first handle; and wherein when the collapsible bunk bed system is in the stowed state, the first and second bunks are flush substantially along their lengths from first respective terminal ends to opposing second respective terminal ends such that the collapsible bunk bed system forms a substantially rectangular cuboid when in the stowed state.

16. The collapsible bunk bed system of claim 15, further comprising, when in a deployed state, a retaining lip of the first platform that is located at a top of the first container, and a retaining lip of the second platform that is located at a top of the second container.

17. The collapsible bunk bed system of claim 16, wherein, when in a stowed state, an orientation of the first container is same as in the deployed state, and an orientation of the second container is inverted so that the first retaining lip and the second retaining lip abut and are flush substantially along the lengths of the first and second containers from respective first terminal ends to opposing second terminal ends of the containers, such that the collapsible bunk bed system forms a substantially rectangular cuboid.

18. The collapsible bunk bed system of claim 15, further comprising:

a drawer opening disposed in a side of each of the first and second containers; and a foldable drawer configured to be received by the drawer opening in the side of each of the first and second containers when in the deployed state.

19. The collapsible bunk bed system of claim 18, wherein in the stowed state, the foldable drawers fit within a volume of the first and second bunks.

20. The collapsible bunk bed system of claim 15, wherein the first and second platforms are hingedly coupled to the first and second containers, respectively.

* * * * *